US006913044B2

(12) United States Patent
Zwehl et al.

(10) Patent No.: US 6,913,044 B2
(45) Date of Patent: Jul. 5, 2005

(54) ELECTRIC MOTOR DIRECT DRIVE FOR THE REED OF A LOOM

(75) Inventors: Dietmar Von Zwehl, Achberg (DE); Michael Lehmann, Lindau (DE); Dieter Mayer, Wangen (DE)

(73) Assignee: Lindauer Dornier Gesellschaft mbH, Lindau (DE)

( * ) Notice: Subject to any disclaimer, the term of this patent is extended or adjusted under 35 U.S.C. 154(b) by 212 days.

(21) Appl. No.: 10/291,040

(22) Filed: Nov. 7, 2002

(65) Prior Publication Data

US 2003/0084951 A1 May 8, 2003

(30) Foreign Application Priority Data

Nov. 8, 2001 (DE) ..... 101 54 941

(51) Int. Cl.[7] ..... D03D 49/62
(52) U.S. Cl. ..... 139/1 E
(58) Field of Search ..... 139/1 E, 100, 139/188 R, 25, 11; 310/261, 264, 254

(56) References Cited

U.S. PATENT DOCUMENTS

| | | | |
|---|---|---|---|
| 5,058,628 A | 10/1991 | Spiller et al. | |
| 5,499,662 A | 3/1996 | Vogel et al. | |
| 5,518,039 A | 5/1996 | Haeussler et al. | |
| 6,065,503 A | 5/2000 | Berktold et al. | |
| 6,418,972 B2 * | 7/2002 | Krumm et al. | 139/188 R |

FOREIGN PATENT DOCUMENTS

| | | |
|---|---|---|
| DE | 727550 | 11/1942 |
| DE | 4405776 | 8/1995 |
| DE | 19821094 | 7/1999 |
| DE | 10021520 | 11/2001 |
| EP | 0268762 | 6/1988 |
| EP | 0440579 | 8/1991 |
| EP | 0892100 | 1/1999 |
| EP | 1152077 | 11/2001 |
| JP | 59199841 | 11/1984 |

* cited by examiner

*Primary Examiner*—Peter Nerbun
(74) *Attorney, Agent, or Firm*—W. F. Fasse; W. G. Fasse

(57) ABSTRACT

A direct drive for a loom reed includes a linear motor carrying out a linear oscillating motion, or an arc segment motor carrying out a pivoting oscillating motion, or a circular coaxial motor carrying out a pivoting oscillating motion. The circular coaxial motor has a hollow shaft rotor arranged within a hollow shaft stator, and may further have an additional hollow shaft stator arranged within the rotor in a sandwich motor construction. The arc segment motor and the linear motor may similarly have a rotor member sandwiched between two stator members. Two motor units can be provided respectively above and below the weaving plane to drive the reed together. With these measures, the driving force is increased, yet the drive arrangement is confined to the available installation space.

36 Claims, 13 Drawing Sheets

ELECTRIC MOTOR DIRECT DRIVE FOR THE REED OF A LOOM

PRIORITY CLAIM

This application is based on and claims the priority under 35 U.S.C. §119 of German Patent Application 101 54 941.5, filed on Nov. 8, 2001, the entire disclosure of which is incorporated herein by reference.

FIELD OF THE INVENTION

The invention relates to a direct drive arrangement including an electric motor, for driving the weaving reed of a loom, whereby the drive arrangement includes a moving part designated as a rotor and a stationary part designated as a stator with an air gap therebetween, and with the weaving reed rigidly connected to the rotor.

BACKGROUND INFORMATION

U.S. Pat. No. 6,418,972 (Krumm et al.) and corresponding German Patent Laying-Open Document 100 21 520 A1 disclose a direct drive for the reed of a loom of the general type mentioned above. The entire disclosure of U.S. Pat. No. 6,418,972 is incorporated herein by reference. The known direct drive arrangement comprises an integrated direct drive electric motor and does not require any intervening transmission means between the electric motor and the reed. A first embodiment of the known arrangement involves a circular coaxial drive that is arranged essentially rotationally symmetrically about the reed support shaft, which carries the reed to cause a pivoting oscillation of the reed about the axis of the reed support shaft. A second embodiment of the known arrangement involves an arcuate "linear" drive that oscillates or pivots in an angularly synchronous manner with the reed along an arc path. In this linear drive, the pivot or oscillation axis of the oscillating motion of the reed is located within the structural elements of the reed or the reed drive.

It should be noted that the prior art "linear" drive does not involve true straight line linear motor components producing a straight line linear motion, but rather refers to a motor with arcuate components that produce an arcuate pivoting motion so that the reed oscillates or pivots back and forth along an arc path. In both embodiments of the known arrangement, the reed support shaft itself can be either a stationary fixed component or a moving component, about which the reed pivots in an oscillating manner, or the reed is rigidly fixed to the reed support shaft, which forms the rotor and pivots about its own longitudinal axis.

In both embodiments of the known arrangement, either the fixed component of the motor carries permanent magnets while the movable component of the motor is energized with a driving current, or the movable component of the motor carries the permanent magnets while the fixed or stationary component of the motor is energized by a driving current. Alternatively, at least a part or portion of the motor may be both provided with permanent magnets and energized with a driving current.

In view of the relatively small available installation space for the known embodiments of the direct drive arrangement, it is difficult to develop the rather large rotational moments or torques that are required for driving a typical reed of a modern high speed loom. Thus, it has been found that both embodiments of the known direct drive arrangement are preferably to be improved in order to increase the rotational moments or torques that can be achieved. It should further be noted that attempts to increase the size of the known arrangements by allocating a larger installation space for each respective drive arrangement would undesirably increase the total space requirement or bulkiness of the drive, and would also disadvantageously increase the total mass and the associated inertial moment of the moving components of the drive arrangement itself, which in turn would directly increase the required torque for achieving the required drive power. Therefore, some other technical improvement is still desirable.

SUMMARY OF THE INVENTION

In view of the above, it is an object of the invention to provide a direct drive arrangement for the reed of a loom, with optimum utilization of the available installation space, and with comparatively large surface areas of the active surfaces of the electric drive motor that are required for generating or developing the rotational torque and drive force and power, without correspondingly increasing the total moving mass and the associated mass inertial moment. Another object of the invention is to increase the drive force and drive power that can be generated by the direct drive arrangement, without increasing the total required installation space. The invention further aims to avoid or overcome the disadvantages of the prior art, and to achieve additional advantages, as apparent from the present specification. The attainment of these objects, however, is not a required limitation of the claimed invention.

The above objects have been achieved according to the invention, in a direct drive arrangement for driving the reed of a loom, comprising an electric motor, and particularly an integrated electric motor comprising at least one moving component designated as a rotor and at least one stationary component designated as a stator, whereby the reed is connected to the at least one rotor by a suitable reed support, e.g. a reed sley or reed battens.

Throughout this specification, the term "rotor" designating the moving component or components of the electric motor drive arrangement does not imply a complete rotational or rotary movement, and does not imply or require a circular or rotationally symmetrical shape of the rotor. Instead, the rotor (and therewith the reed) carries out a pivoting motion characterized by a back-and-forth oscillation on an arc path (e.g. an angular portion of a circle), or a straight line linear motion characterized by a back-and-forth oscillation on a straight line path.

These two different types of oscillating motion can be achieved by three different structural embodiments of the electric motor. A first motor embodiment has a rotationally symmetrical or generally circular construction around a pivot axis, and carries out the oscillating pivoting motion described above. A second motor embodiment has an arc-shaped or circular-segment-shaped construction, and carries out the oscillating pivoting motion described above. A third motor embodiment has a straight linear construction, and carries out the straight linear oscillating motion described above. The second and third motor embodiments could both be generally characterized as a non-circular motor or even as a "linear motor", whereby the non-circular shape of the rotor and of the stator includes either an arcuate shape or a straight linear shape. Thus, it should also be understood that the term "linear motor" does not strictly require a straight line linear motion, but may alternatively involve an arcuate or curved "linear" motion that pivots cyclically back-and-forth along an arc with a radius of curvature about an effective pivot axis.

According to one feature of the first embodiment of the invention, the reed support shaft is embodied as a hollow shaft, so that the radius of the shaft may be significantly increased in comparison to prior art solid shafts, without significantly increasing the mass inertial moment thereof, because the mass of the hollow shaft will be correspondingly less than that of a solid shaft made of the same material and having the same outer diameter. Simultaneously, by displacing the mass to a greater radial distance from the rotation axis, i.e. in the annular wall of the hollow shaft, an increased strength-to-weight ratio of the shaft is achieved.

In one embodiment, the reed support shaft serves directly as the rotor of the electric motor direct drive, and particularly, is arranged as an internal rotor that is located radially inwardly from the stator toward the rotation axis. In such an embodiment, a substantially larger air gap surface or active surface is achieved between the rotor and the stator when using a hollow shaft with a larger diameter in comparison to a solid shaft with a smaller diameter. As a result, the inventive arrangement achieves a large effective driving force in comparison to an internal rotor motor having a solid shaft rotor with the same mass inertial moment as the inventive hollow shaft rotor. Simultaneously, the increased radius of the hollow shaft in comparison to that of a solid shaft of the same mass provides a larger radial lever arm or effective factor for the rotational moment or torque that is to be applied, because the torque is given by the product of the force and the radius. Thus, the rotational moment or torque that can be developed increases, in total, quadratically with the increasing radius of the shaft.

A further embodiment of the invention provides another stator or a system of stators installed in the hollow inner space of the hollow shaft forming the rotor. This inner stator or inner stator system develops a rotational moment or torque in parallel to, and in addition to, the outer stator or stator system arranged radially outwardly from the hollow shaft rotor. Thus, the inner stator system, the reed support shaft as the rotor of the direct drive, and the outer stator system are coaxially arranged relative to each other, about the oscillating pivot axis of the reed. The electric motor direct drive for the reed in this embodiment thus forms a so-called coaxial "sandwich motor" drive, which provides plural effective air gaps, whereby the total effective air gap surface of this drive is nearly doubled in comparison to the provision of a single inner rotor motor. This also leads to almost doubling the torque that can be developed.

The electric motor according to the invention can be constructed and operated generally according to the motor principle of a synchronous servomotor with permanent magnets arranged on the rotor, as disclosed in the above mentioned U.S. Pat. No. 6,418,972, which is incorporated herein by reference. Alternatively, however, the invention further provides that especially the "sandwich motor", having two coaxial layered stators or stator systems with a rotor or rotor system therebetween, can be embodied as a transverse flux motor, wherein preferably the rotor is similarly provided with permanent magnets. As further alternatives, the inventive motor arrangement can be embodied according to the general principles of a direct current motor, due to the high achievable dynamics or dynamic range, or a reluctance motor, also due to the high achievable dynamics or dynamic range and the simple structure. Another alternative is an embodiment as an asynchronous squirrel cage motor with a short-circuited rotor, a three-phase induction motor. In any event, both the rotor and the stator participate or cooperate in electromagnetically driving the rotor in accordance with generally known principles and structures (e.g. regarding the arrangement of windings and/or permanent magnets).

In the second general embodiment of the invention as mentioned above, the stator and the rotor of the direct drive arrangement are configured with an arcuate shape, and particularly with a structural arrangement to avoid locating the pivoting axis of the reed within the structure of the drive, i.e. the pivot axis of the reed is located outside of its drive. This makes it possible to considerably increase the radius of the pivoting motion about the pivoting axis, and allows a relatively large air gap surface to be achieved, especially in connection with the above described sandwich motor structure. Moreover, the components that are determinative of the mass inertial moment of the weaving reed are located at the height or level of the weaving plane, i.e. above the air gap with respect to a view from the pivot axis. As a particular embodiment feature of the invention, the arc-shaped structure of the stator and of the rotor, as seen on a radial section is respectively formed as an arc segment of a circular ring or annulus. The inner and outer radii of the annular arc segments in this context are finite, i.e. $<\infty$, which means that these arc segments have a circular arc curvature rather than being straight line segments.

Another detail feature of the invention provides that an additional stator can be arranged coaxially relative to the first stator and the rotor, with the rotor arranged between the two stator, and optionally with any number of additional alternating coaxial rotors and stators. This feature can be used in connection with any of the other embodiments of the invention. In a coaxial layered arrangement, the innermost component, e.g. the inner stator or the rotor, can be embodied as a solid shaft. In any event, with this layered sandwich arrangement having two stators and two air gaps, the total air gap surface is substantially doubled, which achieves a relatively high dynamic range, and a relatively high angular velocity of the reed, which ultimately leads to a relatively high weaving speed or loom operation speed in terms of weft shots per minute, in comparison to the prior art.

In the embodiment of the direct drive as a linear electric motor direct drive, the movable parts of the motor are rigidly connected to the reed and are preferably movable along a true linear straight line path, which is preferably oriented horizontally. As a further feature, a first linear motor including a first rotor and a first stator can be arranged above the weaving plane, and a second linear motor comprising a second rotor and a second stator can be arranged below the weaving plane. The moving parts or rotors of these linear drives are each rigidly connected by suitable means, e.g. a reed sley, to the weaving reed.

This embodiment provides the following advantages. On the one hand, the available space below the weaving reed is better utilized in comparison to a coaxially constructed drive. On the other hand, the area or space above the weaving reed is additionally utilized as an installation space for the drive components. The installation space below the weaving reed can be better utilized basically due to the general advantage of the linear drive having a true straight line drive path, whereby an increase of the air gap surface merely increases the mass of the moving parts, without increasing an effective lever arm of the achieved driving force. In comparison, in a coaxially arranged drive system having a pivoting rotor, an increase of the air gap surface leads to an increase of the mass, which is further multiplied by the radius of the rotor, so that the mass inertial moment of such a coaxial drive arrangement increases more drastically than the inertial moment (associated only with the mass) of the moving part of a linear motor moving along a straight line path. Furthermore, dividing the linear drive between respective portions or areas above and below the weaving reed utilizes additional installation space as mentioned above, and also stabilizes the weaving reed motion.

The sandwich motor arrangement according to the invention can also be applied to the linear motor embodiment. Namely, the air gap surface of the linear motor can be enlarged by arranging the movable part (i.e. the rotor) and the stationary part (i.e. the stator) in plural alternating layers in a direction perpendicular to the general back-and-forth motion of the reed. In other words, assuming the typical horizontal motion of the reed, a vertical stacking of alternate rotors and stators achieves a relatively large total air gap surface with a relatively small lateral extent or dimension of the drive in the direction of motion of the reed. That is important, in order not to reduce the space available for the shed formation, e.g. the space for the motion of the heald shafts. The inventive linear drive involving a drive motion along a straight line path can be particularly embodied as a synchronous motor preferably having permanent magnets provided on the rotor, or as a transverse flux motor preferably having permanent magnets provided on the rotor. Alternatively, the linear motor can be embodied as a direct current motor or as a reluctance motor, due to the advantages already mentioned above.

BRIEF DESCRIPTION OF THE DRAWINGS

In order that the invention may be clearly understood, it will now be described in connection with example embodiments, with reference to the accompanying drawings, wherein.

DETAILED DESCRIPTION OF A PREFERRED EXAMPLE EMBODIMENT AND OF THE BEST MODE OF THE INVENTION

Figure 1A:
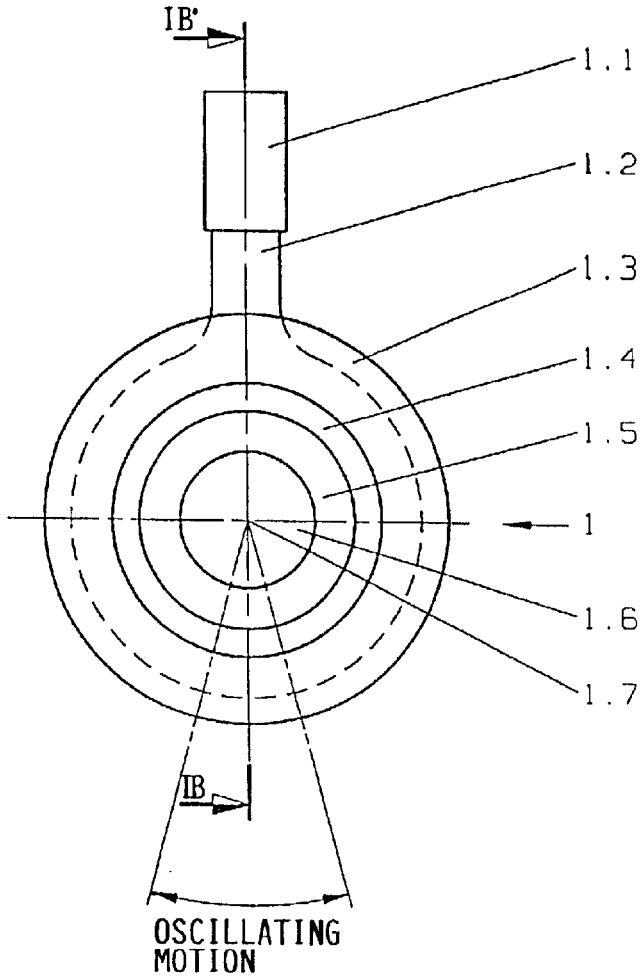
FIG. 1A is a schematic side view of an electric motor direct drive for the reed of a loom, having a rotationally symmetrical circular structure according to the invention.
Figure 1B:
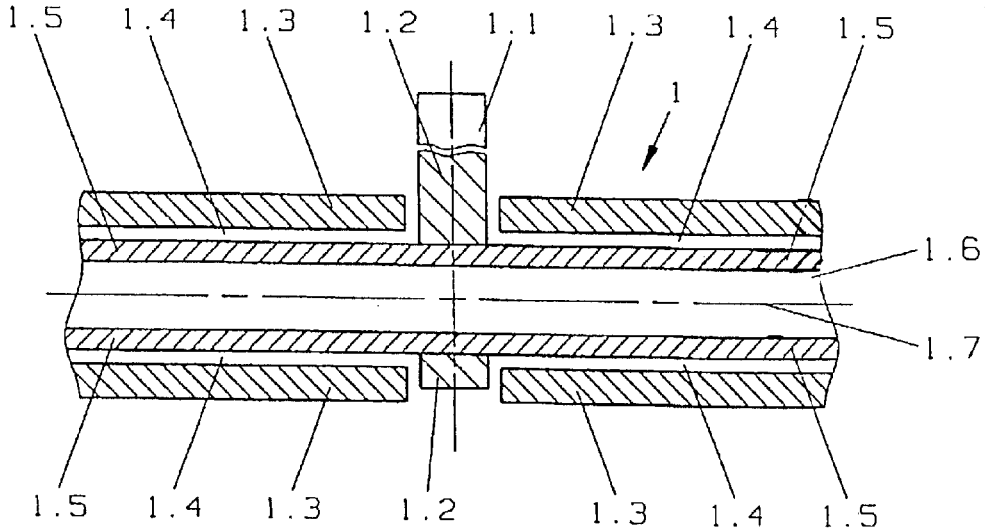
FIG. 1B is a schematic sectional view along the line IB—IB of FIG. 1A.

FIGS. 1A and 1B schematically show a rotationally symmetrical or circular construction of an electric motor direct drive 1 for the weaving reed 1.1 of a loom. The direct drive 1 includes a rotor 1.5 embodied as a hollow shaft 1.6, and a stator 1.3 that is also generally embodied as a hollow shaft or axle. Note that although the stator is said to be embodied as a "shaft", it is a fixed or stationary component and does not rotate or pivot. The reed 1.1 is rigidly connected by a reed support, e.g. a reed sley 1.2, to the rotor 1.5. At the location of each support arm or batten of the reed sley 1.2, the hollow shaft of the stator 1.3 is cut open for at least the rotational angular range of the reed, to allow the reed sley 1.2 to pass therethrough and be connected to the rotor 1.5. The rotor 1.5 is arranged concentrically inside the stator 1.3 about the common pivot axis 1.7, and with an annular air gap 1.4 between the stator 1.3 and the rotor 1.5.

While it is not expressly shown in the drawings, the stator 1.3 and the rotor 1.5 are supported relative to each other by any suitable bearings or the like to allow the pivoting motion of the rotor 1.5, and are each equipped respectively with permanent magnets and/or windings, in any conventionally known manner. Thereby, the general schematic arrangement shown in the drawings may be particularly constructed as any suitable form of conventional electric rotor, e.g. a synchronous servomotor, a direct current motor, a reluctance motor, or the like. By appropriate actuation and control of the direct drive motor 1, the rotor 1.5 is caused to pivot or oscillate back-and-forth in an oscillating motion about the pivot axis 1.7, whereby the rotor 1.5 directly carries along and moves the reed sley 1.2 in the corresponding oscillating motion, so as to thereby drive the reed 1.1 in the corresponding oscillating motion for carrying out the weft beat-up. The hollow shaft configuration of the rotor 1.5 advantageously achieves an increased drive torque in comparison to a smaller diameter solid shaft rotor, as discussed above.

Figure 1C:
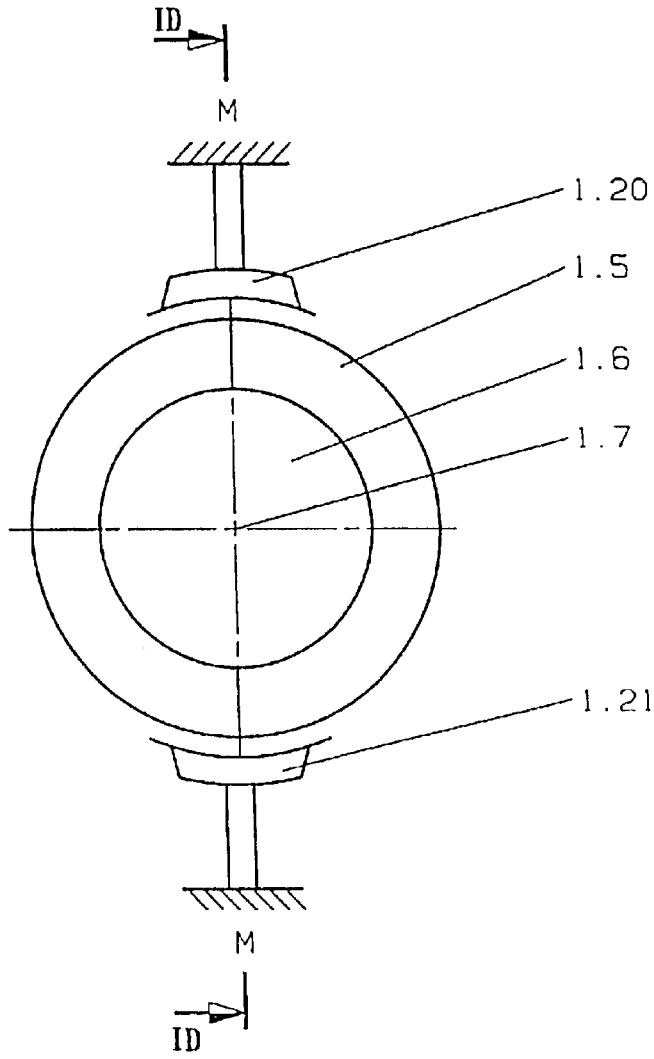
FIG. 1C is another schematic side view of the drive arrangement according to FIG. 1A, additionally equipped with braking means.
Figure 1D:
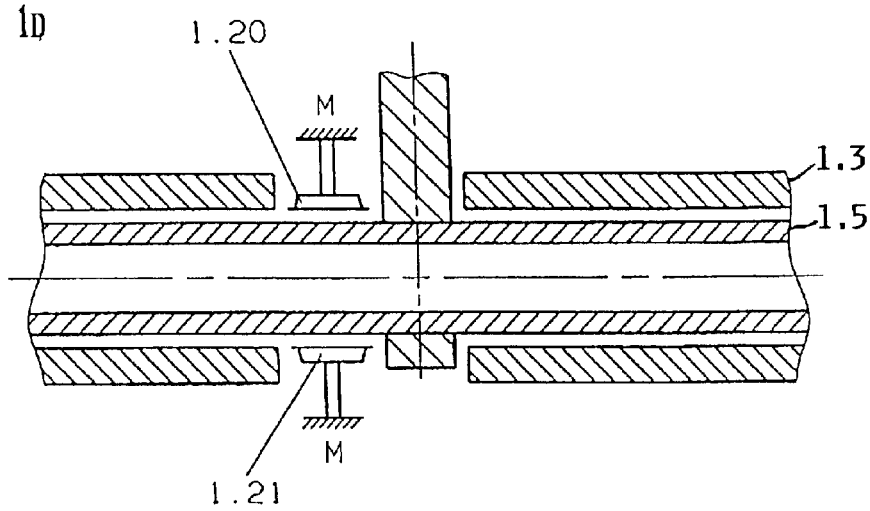
FIG. 1D is a schematic sectional view along the section line ID—ID of FIG. 1C.

FIGS. 1C and 1D schematically illustrate a drive arrangement corresponding to that of FIGS. 1A and 1B, but additionally equipped with a pair of braking arrangements or brake devices 1.20 and 1.21 that act on the rotor 1.5, to positively brake and stop the rotor 1.5, e.g. at the ends or reversal points of the oscillating pivoting motion. The brake devices 1.20 and 1.21 can be any conventionally known brake arrangements for stopping a rotary or pivoting shaft, and may be electromagnetically or pneumatically actuated, for example.

Figure 2A:
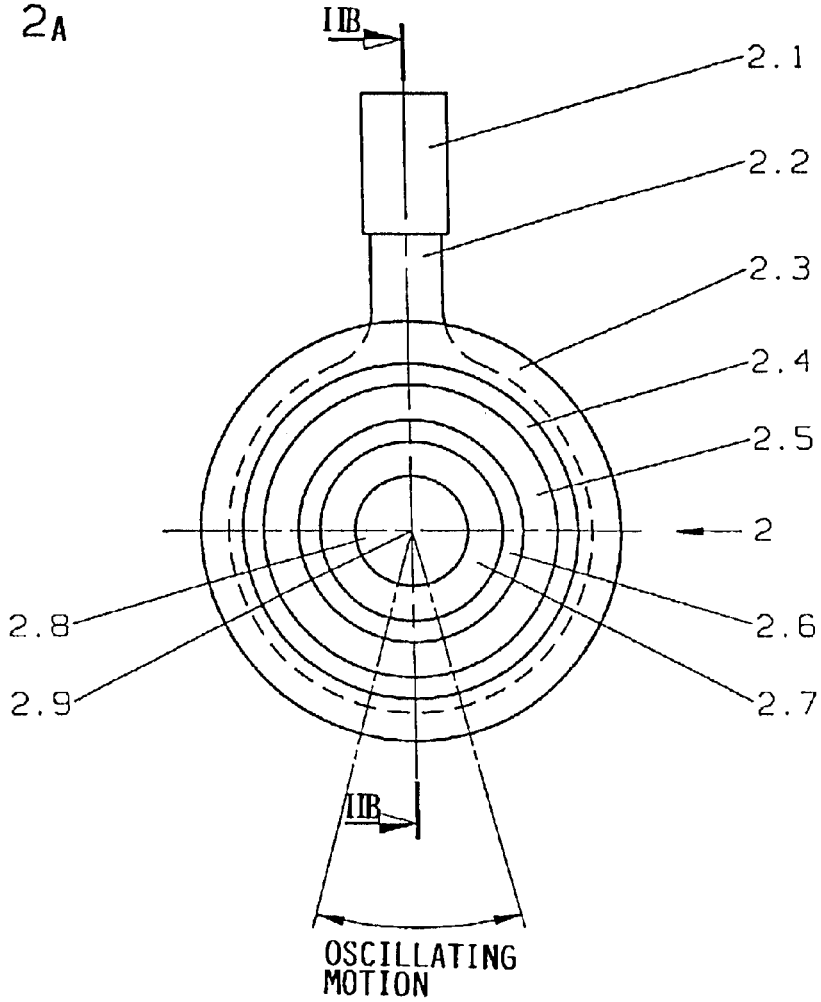
FIG. 2A is a schematic side view similar to that of FIG. 1A, but showing a second embodiment of the electric motor direct drive according to the invention, having plural coaxial stators.
Figure 2B:
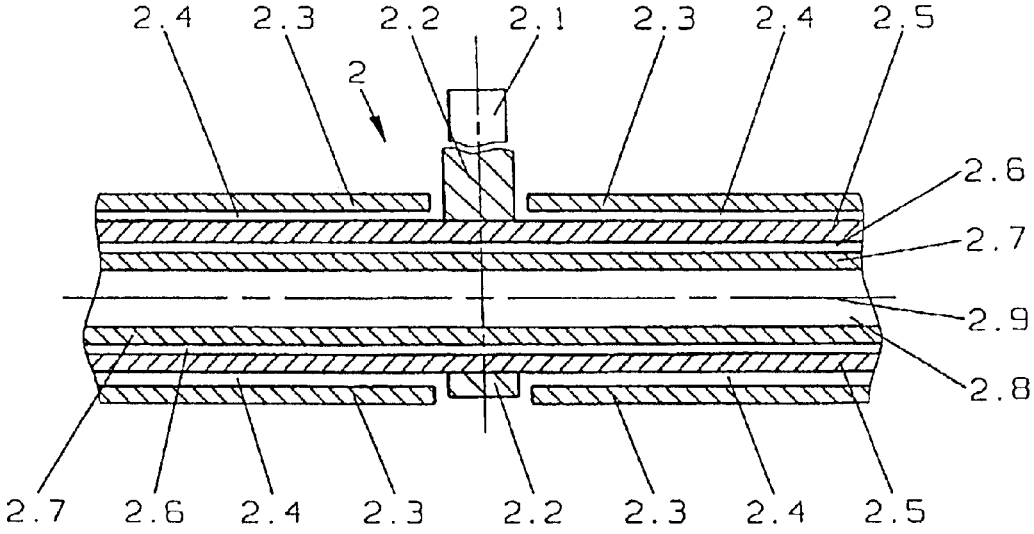
FIG. 2B is a schematic sectional view along the line IIB—IIB of FIG. 2A.

FIGS. 2A and 2B schematically show a rotationally symmetrical drive arrangement 2 having a "sandwich motor" construction. This motor drive arrangement 2 generally corresponds to the above described drive arrangement 1 according to FIGS. 1A and 1B, except that the present drive arrangement 2 includes an additional internal stator 2.7. Namely, the drive arrangement 2 includes a rotor 2.5 embodied as a hollow shaft and connected rigidly to a reed sley 2.2 that carries the reed 2.1. The drive arrangement 2 further comprises an outer stator 2.3 that is embodied as a hollow shaft and surrounds the rotor 2.7 with an air gap 2.4 therebetween, concentrically or coaxially about the pivot axis 2.9. The outer stator 2.3 has an opening to allow the reed sley 2.2 to pass therethrough from the rotor 2.5, at least for the rotational angular range of the reed. The arrangement 2 further comprises an additional inner stator 2.7 that is also embodied as a hollow shaft 2.8 and arranged coaxially within the rotor 2.5 with an air gap 2.6 therebetween, about the pivot axis 2.9. Both of the stators 2.3 and 2.7 as well as the rotor 2.5 are embodied as active components of a motor, e.g. equipped with permanent magnets and/or windings, to achieve almost a doubling of the active air gap 2.4 and 2.6, and almost a doubling of the resulting drive torque, in comparison to the embodiment of FIGS. 1A and 1B. It should be understood that further components such as rotary bearings support the rotor relative to the stators, but such conventional bearings and the like are not shown in the drawings for the purpose of schematic simplicity.

Figure 2C:
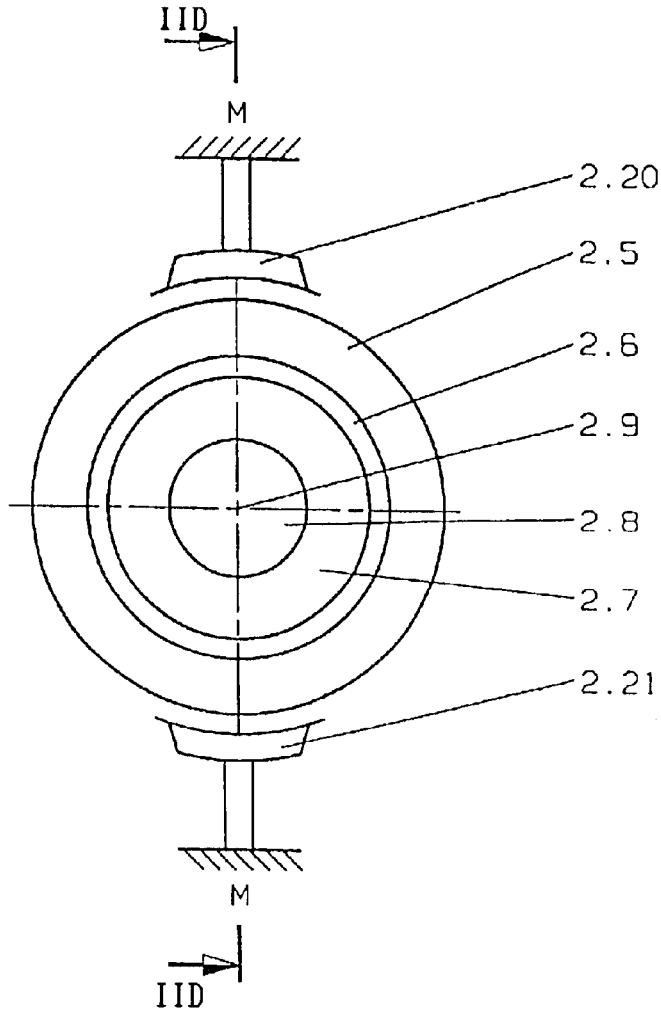
FIG. 2C is a schematic side view corresponding to FIG. 2A, but additionally showing the provision of braking means.
Figure 2D:
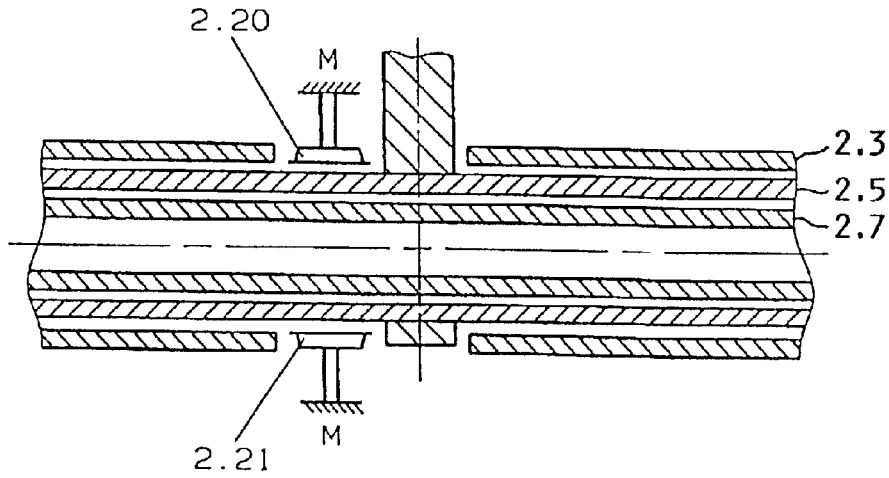
FIG. 2D is a schematic sectional view along the section line IID—IID of FIG. 2C.

FIGS. 2C and 2D schematically show a drive arrangement similar to that of FIGS. 2A and 2B, but further including braking arrangements or brake devices 2.20 and 2.21 that are effective on the rotor 2.5, for positively stopping the motion of the rotor 2.5.

Figure 3A:
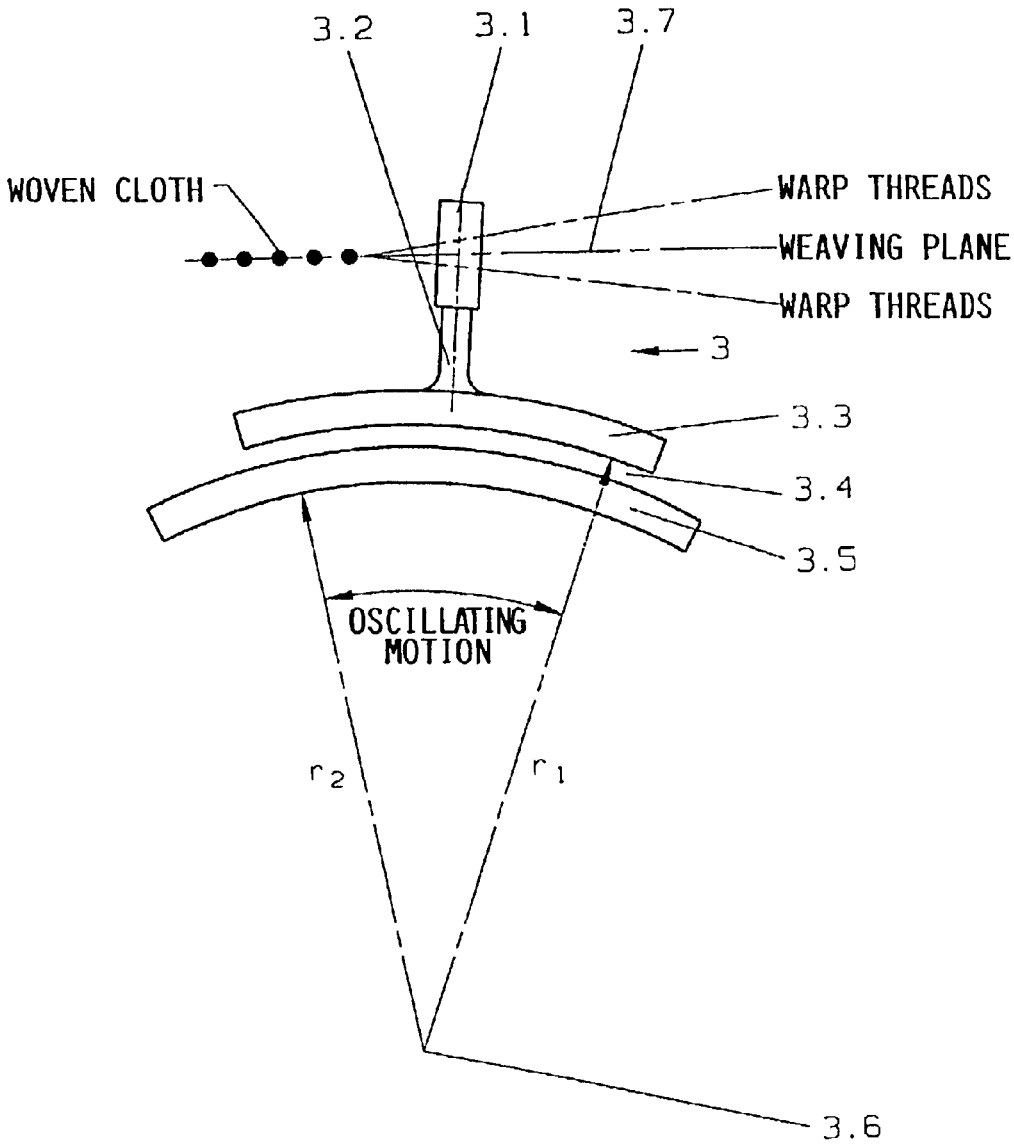
FIG. 3A is a schematic side view of a linear direct drive according to the invention, having an arcuate shape and motion, and being arranged below the weaving plane.

FIG. 3A schematically shows a linear drive arrangement 3 for driving the weaving reed 3.1 via a reed sley 3.2. The drive arrangement 3 is arranged below the weaving plane or cloth plane 3.7 and is made up of components that are each configured as circular arc segments or arcuate annular segments. Particularly, the drive arrangement 3 includes an arcuate segment rotor 3.3 and an arcuate segment stator 3.5 arranged spaced apart from each other with an arcuate air gap 3.4 therebetween. The reed sley 3.2 is rigidly connected with the rotor 3.3. The rotor 3.3 has a radius of curvature $r_1$, and the stator 3.5 has a radius of curvature $r_2$ about a common centerpoint 3.6, which also represents the non-physical or fictitious pivot axis about which the rotor 3.3 carries out a back-and-forth arcuate oscillating or pivoting motion. Thereby the rotor 3.3 correspondingly drives the reed sley 3.2 and the reed 3.1 in the same arcuate pivoting or oscillating motion about the pivot axis 3.6, for beating up successive weft threads in successive open sheds formed by respective sheets of warp threads, to form the woven cloth along the weaving plane. The pivot axis 3.6 is located displaced away from any physical component of the drive arrangement or the reed.

Figure 3B:
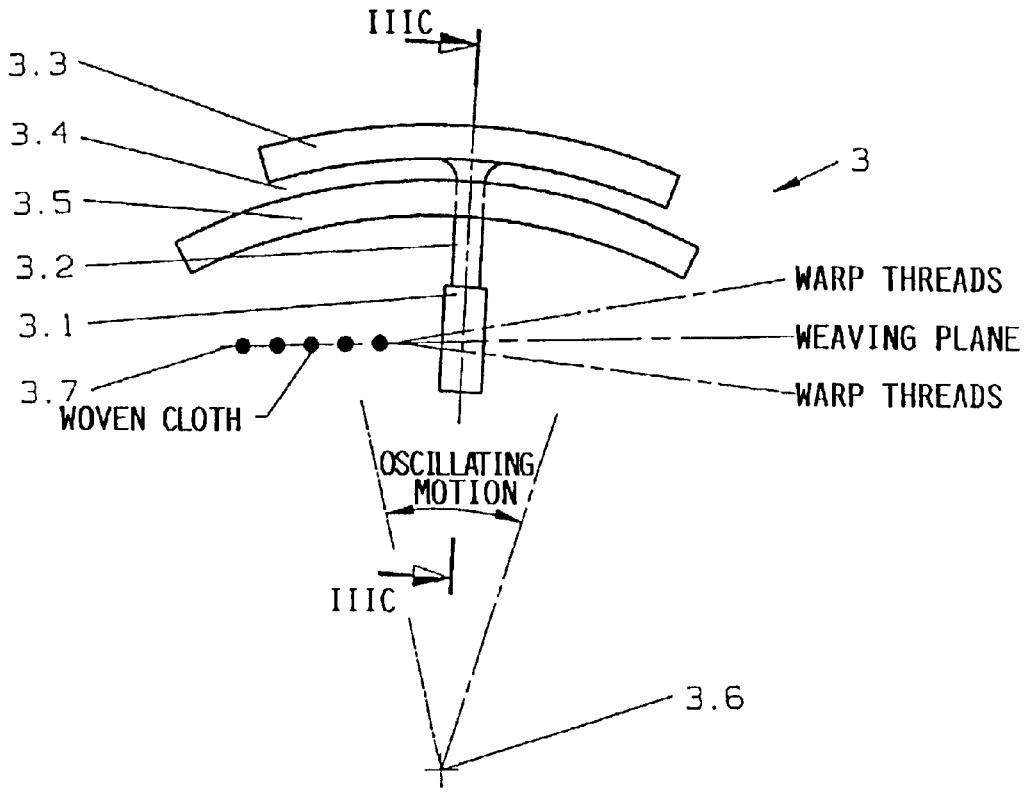
FIG. 3B is a schematic side view of a linear drive similar to that of FIG. 3A, but arranged above the weaving plane.
Figure 3C:
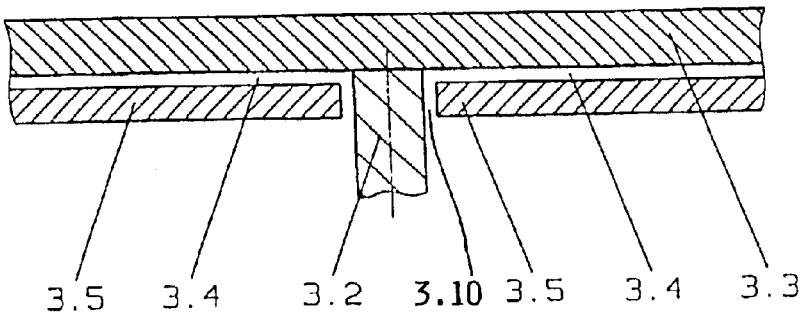
FIG. 3C is a schematic sectional view along the section line IIIC—IIIC of FIG. 3B.

FIGS. 3B and 3C show a linear drive arrangement 3 generally similar to that of FIG. 3A, but arranged above the weaving plane rather than below the weaving plane as in FIG. 3A. Thus, the drive arrangement 3 of FIG. 3B is generally "upside down" relative to the drive arrangement 3 of FIG. 3A. Additionally, the relative positions of the rotor and stator are reversed in FIG. 3B relative to FIG. 3A, namely with the stator closer to the weaving plane. Thus, more particularly, the rotor 3.3 and the stator 3.5 are each arcuately curved about the pivot axis 3.6, while the rotor 3.3 is arranged above the stator 3.5. Therefore, the stator 3.5 has a slot or opening to allow the reed sley 3.2 carrying the reed 3.1 to extend through the stator 3.5, at least over the angular range of the oscillating motion. This slot or opening 3.10 of the stator 3.5 is especially shown in FIG. 3C.

Figure 4A:
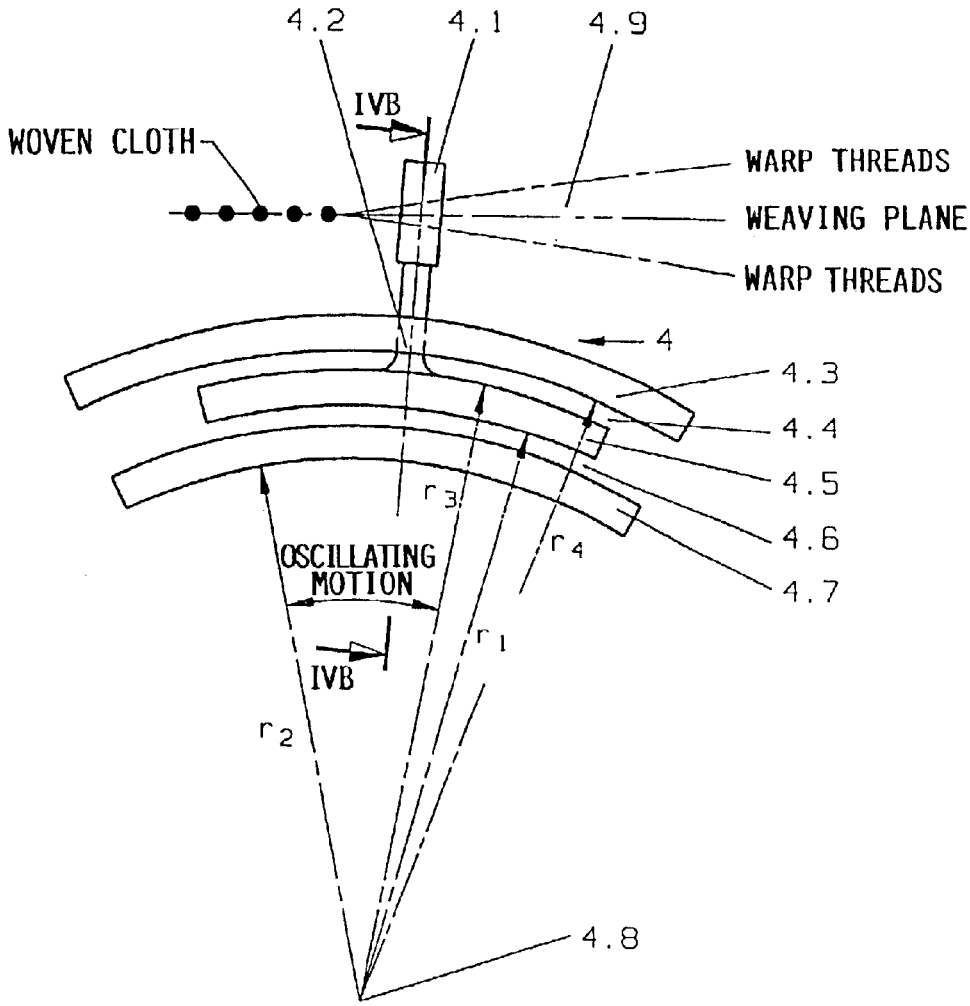
FIG. 4A is a schematic side view of another embodiment of a linear motor drive according to the invention, in a sandwich arrangement with two stators.
Figure 4B:
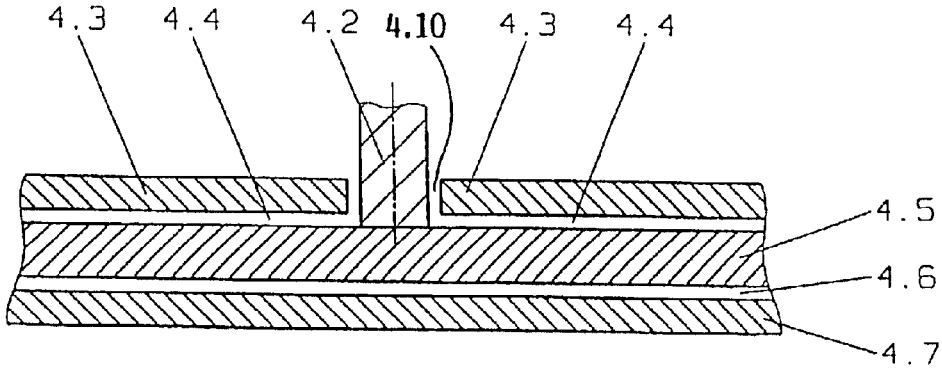
FIG. 4B is a schematic sectional view along the section line IVB—IVB of FIG. 4A.

FIGS. 4A and 4B schematically illustrate a linear drive arrangement 4 located below the weaving plane, generally like the drive arrangement 3 of FIG. 3A. However, the present embodiment of FIGS. 4A and 4B is a linear sandwich motor, including an additional stator in comparison to FIG. 3A. Namely, the drive arrangement 4 includes a first stator 4.7 arranged below the rotor 4.5 with an air gap 4.6 therebetween, and an additional stator 4.3 arranged above the rotor 4.5 with an air gap 4.4 therebetween. To allow the reed sley 4.2 to extend therethrough, the upper stator 4.3 has an opening or slot 4.10 over at least the angular range of the oscillating motion. The inner or lower stator 4.7 has an inner radius of curvature $r_2$, the rotor 4.5 has an inner radius of curvature $r_1$ and an outer radius of curvature $r_3$, and the outer stator 4.3 has an inner radius of curvature $r_4$, each with respect to the common pivot axis 4.8, which is displaced away from any physical component of the drive arrangement.

Figure 5A:
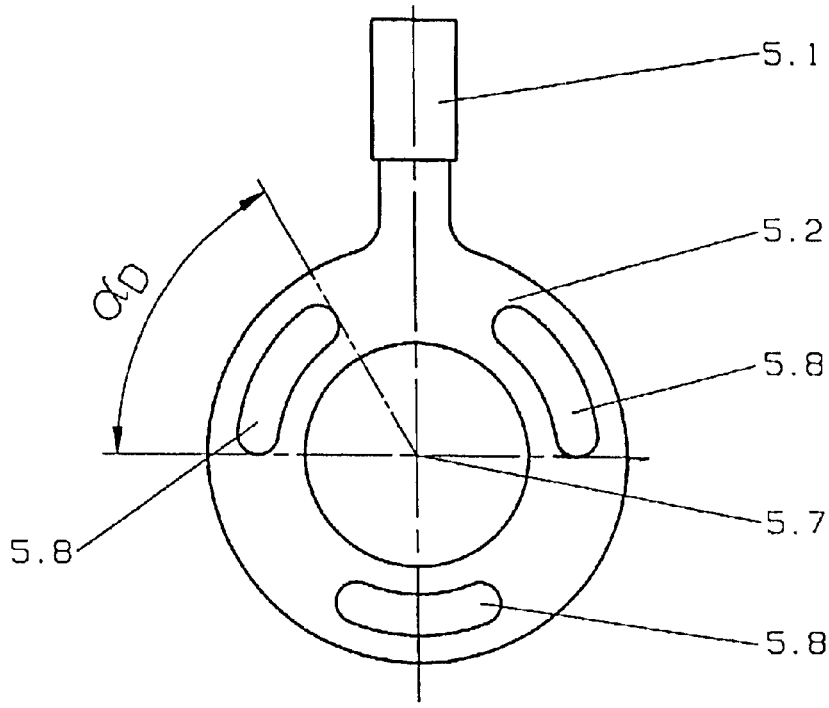
FIG. 5A is a schematic side view of a reed sley with openings for joining together two adjacent motors for a circular oscillating or pivoting reed drive, in accordance with FIGS. 1A to 2D.
Figure 5B:
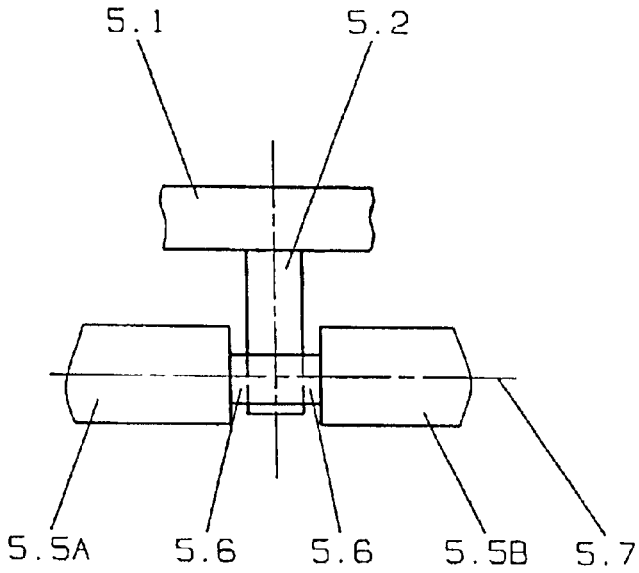
FIG. 5B is a schematic front view of the reed sley according to FIG. 5A, e.g. as seen from the left side of FIG. 5A, with two adjacent electric motor partial drives for the reed being connected together through the openings of the reed sley.

As shown in FIGS. 5A and 5B, a reed sley 5.2 for a pivoting or oscillating reed drive according to FIGS. 1A to 2D has one or more openings 5.8 therein. The openings 5.8 each respectively are arcuate slots extending over a pivot arc with an arc angle $\alpha_D$ corresponding to the angular range of pivoting motion, so as to allow the direct electrical and/or mechanical interconnection 5.6 among plural partial components 5.5A and 5.5B of the stator of the blade drive. This interconnection 5.6 is preferably carried out as a plug-in or plug-together connection that extends through the respective openings 5.8. In this manner, several successive drive arrangements or drive units can be connected to each other across the weaving width of the loom, i.e. along the pivot axis 5.7.

Figure 6A:
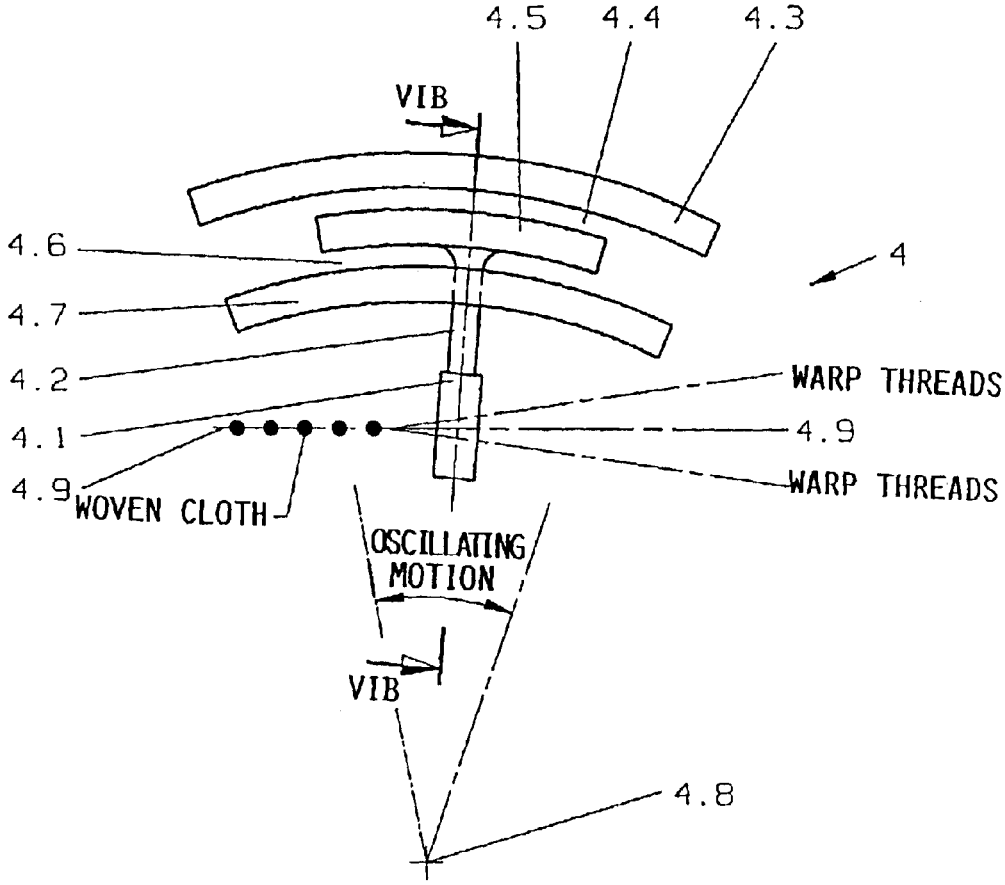
FIG. 6A is a schematic side view of a linear sandwich drive arrangement similar to that of FIG. 4A, but arranged above the weaving plane, in a similar relationship as exists between FIGS. 3B and 3A.
Figure 6B:
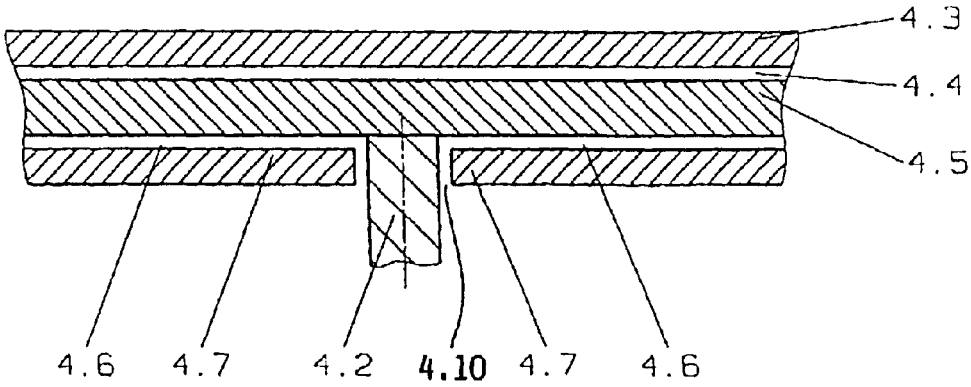
FIG. 6B is a schematic sectional view along the section line VIB—VIB of FIG. 6A.

The drive arrangement 4 shown in FIGS. 6A and 6B generally corresponds to the drive arrangement 4 shown in FIGS. 4A and 4B, except that in FIGS. 6A and 6B the drive arrangement 4 is arranged above the weaving plane 4.9, and is "upside down", i.e. with the reed sley 4.2 extending downwardly through the lower stator 4.7.

Figure 7A:
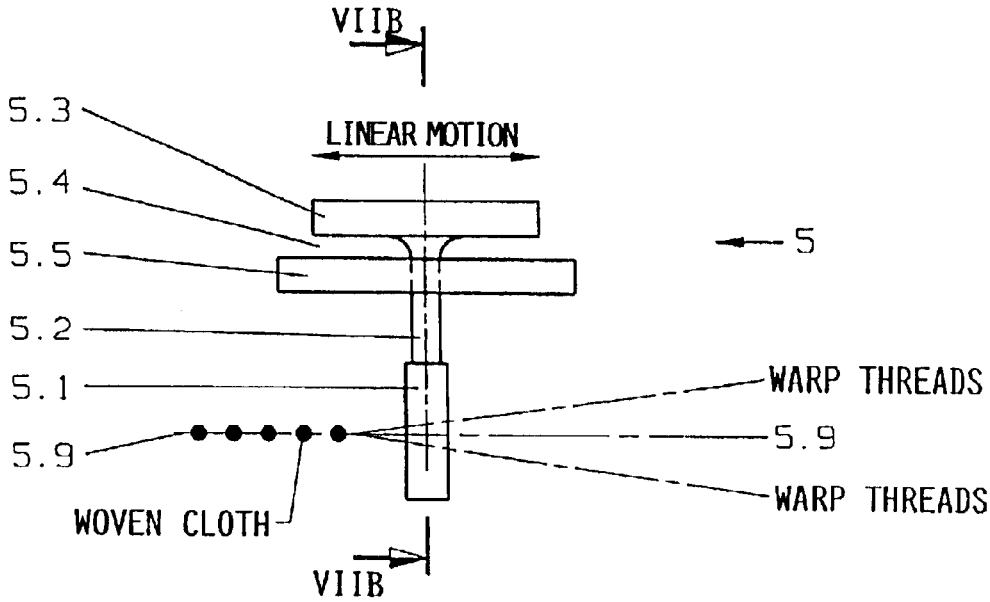
FIG. 7A is a schematic side view of an electric motor linear drive with a true linear straight line motion of the drive rotor and of the reed.
Figure 7B:
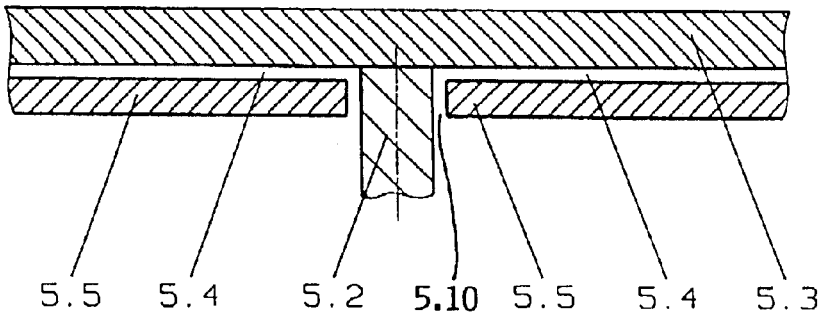
FIG. 7B is a schematic sectional view along the line VIIB—VIIB of FIG. 7A.

FIGS. 7A and 7B illustrate a linear drive arrangement 5 generally similar to the drive arrangement 3 according to FIGS. 3B and 3C, except that the drive arrangement 5 according to FIGS. 7A and 7B is a linear drive arrangement with straight planar components that carry out a true straight line linear motion parallel to the weaving plane. Correspondingly, the reed 5.1 is driven by the reed sley 5.2 in a straight line linear motion rather than a rotary pivoting motion. Particularly, the rotor 5.3 is arranged above the stator 5.5 with an air gap 5.4 therebetween bounded by respective flat planar surfaces of the rotor 5.3 and of the stator 5.5. The reed sley 5.2 extends through a linear slot 5.10 in the stator 5.5, to be rigidly connected to the rotor 5.3. Note that the term "rotor" here still applies to the moving component 5.3, even though this moving component 5.3 does not carry out a rotational or rotary pivoting motion, but rather a true linear straight line oscillating motion.

Figure 7C:
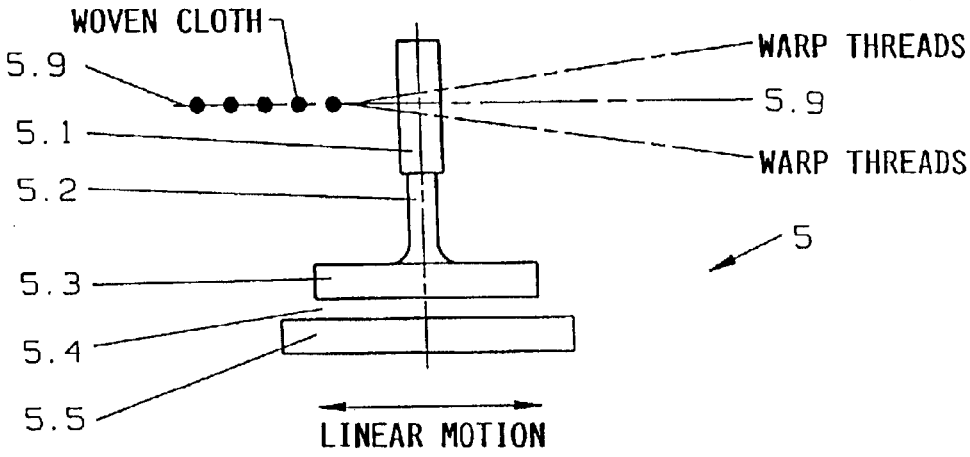
FIG. 7C is a linear drive similar to that of FIG. 7A, but arranged below the weaving plane.

FIG. 7C shows a linear drive arrangement 5 corresponding to that shown in FIG. 7A, except that the rotor 5.3 and the reed sley 5.2 have been turned "upside down", and the overall arrangement 5 has been arranged below the weaving plane 5.9, rather than above the weaving plane 5.9. In the embodiment of FIG. 7C, the rotor 5.3 is arranged closer than the stator 5.5 to the weaving plane 5.9. Therefore, the stator 5.5 of FIG. 7C does not require a pass-through slot 5.10 like the stator of FIGS. 7A and 7B.

Figure 8A:
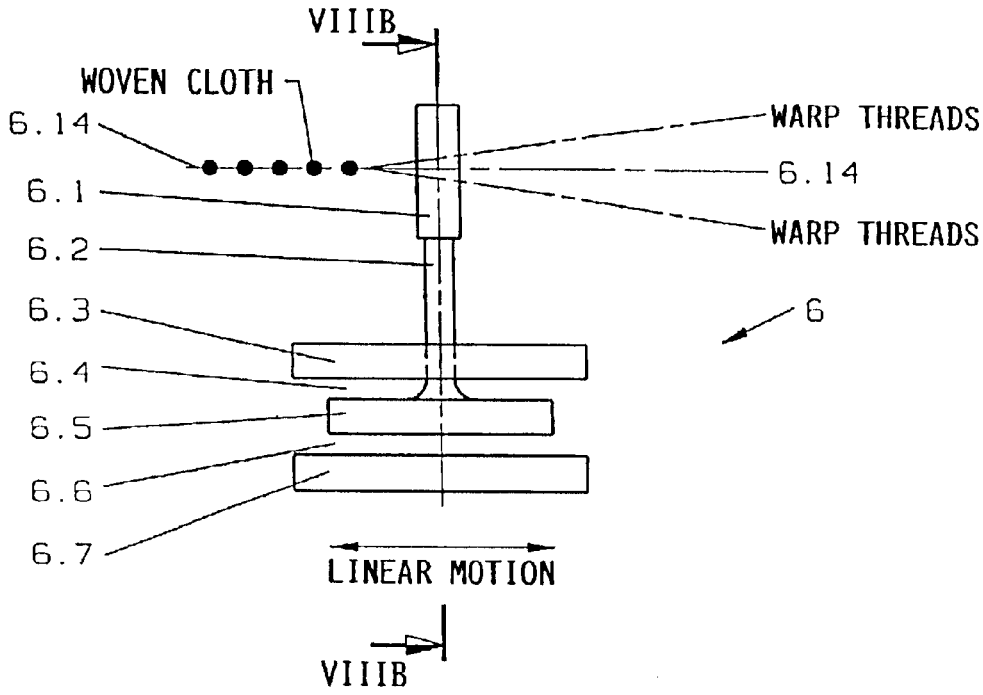
FIG. 8A is a schematic side view of a further embodiment of a linear motor according to the invention, which is arranged below the weaving plane and which comprises a sandwich arrangement of two linear stators with a linear rotor that carries out a straight line linear motion therebetween.
Figure 8B:
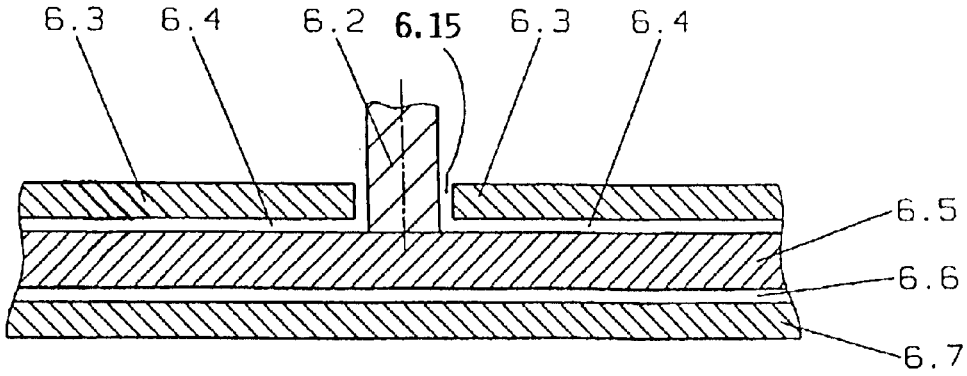
FIG. 8B is a schematic sectional view along the line VIIIB—VIIIB of FIG. 8A.

FIGS. 8A and 8B schematically illustrate a linear drive arrangement 6 that generally corresponds to that of FIG. 7C, but embodied in a "sandwich motor" construction with an additional stator. Namely, the linear drive arrangement 6 arranged below the weaving plane 6.14 according to FIG. 8A includes a linear rotor 6.5 arranged between a lower linear stator 6.7 and an upper linear stator 6.3, with respective air gaps 6.6 and 6.4 respectively therebetween. The reed 6.1 is connected by a reed sley 6.2 rigidly to the linear rotor 6.5, whereby the reed sley 6.2 extends through a linear pass-through slot 6.15 in the upper stator 6.3. The motion of the rotor 6.5, and therewith of the reed 6.1, is a true linear straight line oscillating motion parallel to the weaving plane 6.14.

Figure 9A:
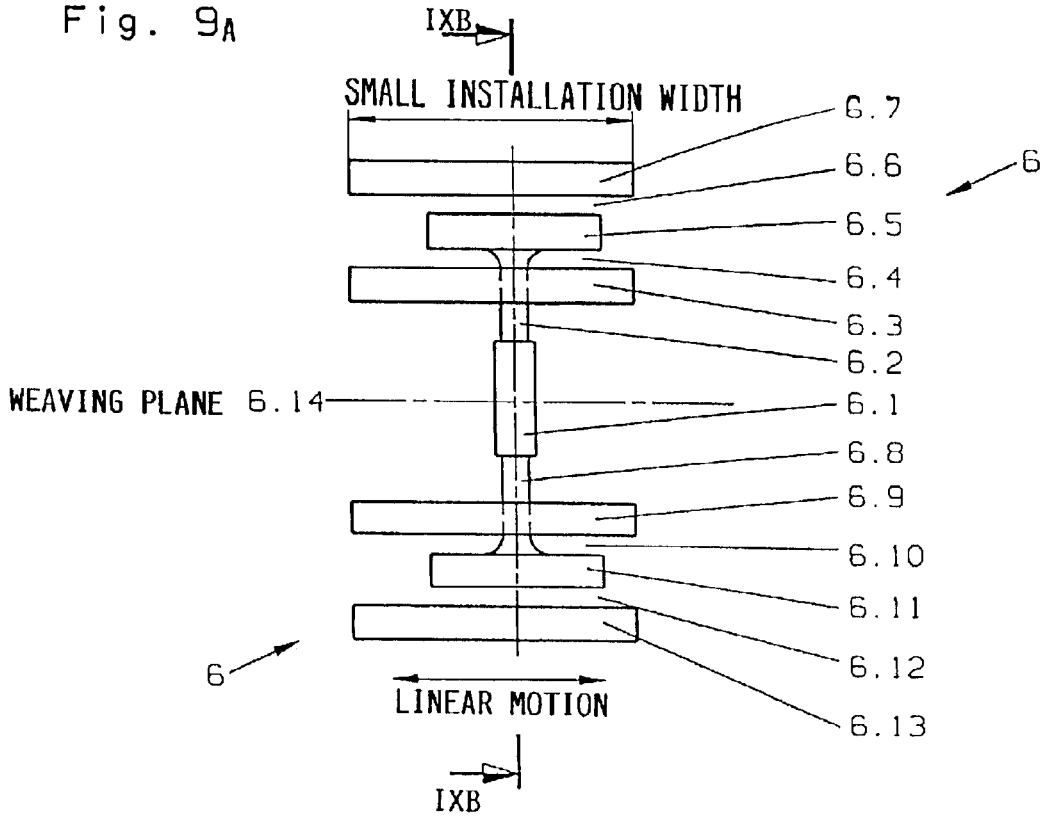
FIG. 9A is a schematic side view of a split or divided linear drive arrangement according to the invention, with a first linear sandwich drive unit above the weaving plane and a second linear sandwich drive unit below the weaving plane, both carrying out a straight line linear motion together with the reed.
Figure 9B:
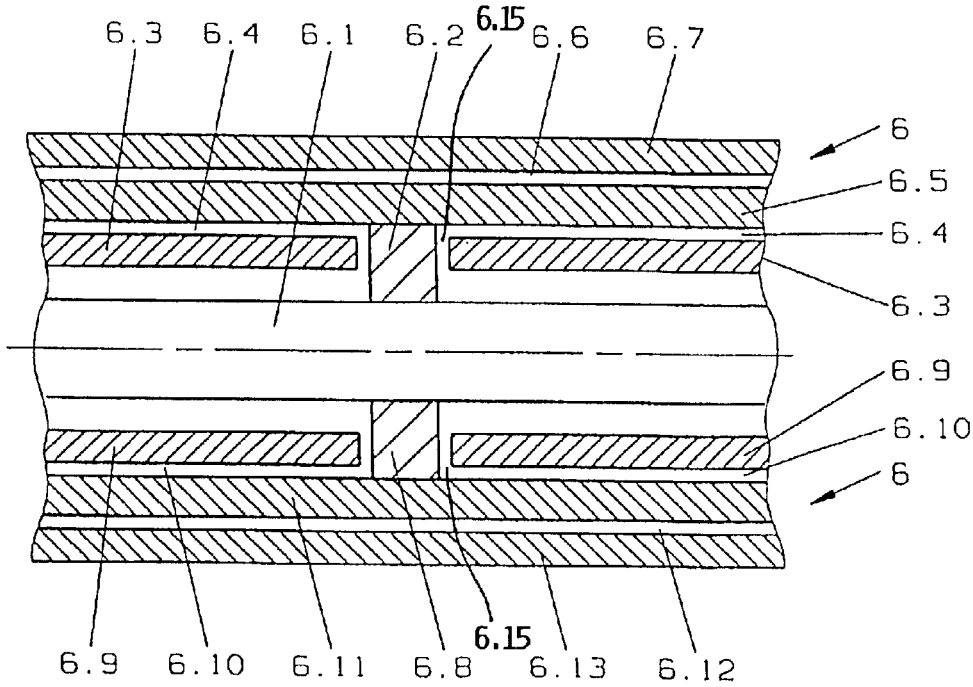
FIG. 9B is a schematic sectional view along line IXB—IXB of FIG. 9A.

FIGS. 9A and 9B schematically represent a linear drive arrangement with two linear sandwich motors according to FIG. 8A, respectively arranged above and below the weaving plane 6.14. The reed 6.1 is connected by an upper reed sley 6.2 to the linear rotor 6.5 of the upper drive unit, and by a lower reed sley 6.8 to the linear rotor 6.11 of the lower drive unit. The upper linear drive unit further includes two stators 6.3 and 6.7, with the rotor 6.5 and respective air gaps 6.4 and 6.6 sandwiched therebetween, whereby the stator 6.3 has a pass-through linear slot 6.15 to allow the reed sley 6.2 to reach the rotor 6.5. The lower drive unit includes two stators 6.9 and 6.13, receiving the rotor 6.11 and two respective air gaps 6.10 and 6.12 sandwiched therebetween, whereby the stator 6.9 has a linear pass-through slot 6.15 to allow the reed sley 6.8 to extend therethrough to reach the linear rotor 6.11. With the dual drive unit arrangement according to FIGS. 9A and 9B, the total drive power can be substantially doubled, while making effective use of an additional installation space above the weaving plane 6.14, and while maintaining a relatively small installation width in the direction of the linear motion.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A reed drive arrangement for a loom, comprising:

an electric motor including a stationary first stator and an oscillatable first rotor that is electromagnetically drivable to oscillate back-and-forth in an oscillating motion relative to said first stator, with a first air gap between said first stator and said first rotor;

a reed support rigidly connected to said first rotor so as to oscillate back-and-forth with said first rotor;

a reed carried by said reed support so as to oscillate back-and-forth with said reed support; and at least one of the following features:

a first feature wherein said oscillating motion is a pivoting motion about a pivot axis, said first stator comprises a hollow annular cylindrical first stator shaft arranged coaxially with respect to said pivot axis, and said first rotor comprises a hollow annular cylindrical first rotor shaft arranged coaxially with respect to said pivot axis inside said first stator shaft; and a second feature wherein said electric motor further comprises a stationary second stator arranged with said first rotor between said first stator and said second stator and with a second air gap between said second stator and said first rotor.

2. The reed drive arrangement according to claim 1, comprising said first feature and said second feature, wherein said second stator is arranged coaxially with respect to said pivot axis inside said hollow annular cylindrical first rotor shaft.

3. The reed drive arrangement according to claim 2, wherein said second stator comprises a solid circular cylindrical second stator shaft.

4. The reed drive arrangement according to claim 2, wherein said second stator comprises a hollow annular cylindrical second stator shaft.

5. The reed drive arrangement according to claim 4, wherein said electric motor further comprises a second rotor comprising a solid circular cylindrical second rotor shaft that is connected rigidly to said first rotor and that is arranged coaxially with respect to said pivot axis inside said hollow annular cylindrical second stator shaft.

6. The reed drive arrangement according to claim 2, wherein said electric motor further comprises a third stator arranged coaxially with respect to said pivot axis radially outside of said first stator, and a second rotor comprising a second hollow annular rotor shaft that is connected rigidly to said first rotor and that is arranged coaxially with respect to said pivot axis between said first stator and said third stator, with a third air gap between said first stator and said second rotor and with a fourth air gap between said second rotor and said third stator.

7. The reed drive arrangement according to claim 1 further comprising a third feature wherein said electric motor is a non-circular motor, wherein said first stator has a cross-sectional stator shape that is non-circular, and wherein said first rotor has a cross-sectional rotor shape that is non-circular.

8. The reed drive arrangement according to claim 7, further comprising said second feature, wherein said second stator has a cross-sectional stator shape that is non-circular.

9. The reed drive arrangement according to claim 8, wherein said electric motor is a straight-line linear motion motor, said oscillating motion is a straight-line linear oscillating motion, said cross-sectional stator shape of said first stator is a linearly extending shape, said first stator has a flat planar first stator surface that faces and bounds said first air gap, said cross-sectional rotor shape of said first rotor is a linearly extending shape, said first rotor has a flat planar first rotor surface that faces and bounds said first air gap, said cross-sectional stator shape of said second stator is a linearly extending shape, said second stator has a flat planar second stator surface that faces and bounds said second air gap, and said first rotor further has another flat planar rotor surface that faces and bounds said second air gap.

10. The reed drive arrangement according to claim 8, wherein said electric motor is a pivoting motion motor, said oscillating motion is a pivoting motion about a pivot axis, said cross-sectional stator shape of said first stator is an arcuate annular segment shape with an arcuate stator surface facing and bounding said first air gap, said cross-sectional rotor shape of said first rotor is an arcuate annular segment shape with an arcuate rotor surface facing and bounding said first air gap, respective radii of curvature of said arcuate stator surface and said arcuate rotor surface originate at said pivot axis, said cross-sectional stator shape of said second stator is an arcuate annular segment shape with an arcuate stator surface facing and bounding said second air gap, and said first rotor further has another arcuate rotor surface facing and bounding said second air gap.

11. The reed drive arrangement according to claim 8, wherein said electric motor further comprises a third stator arranged on a side of said first stator opposite said second stator, and a second rotor that is connected rigidly to said first rotor and that is arranged between said first stator and said third stator, with a third air gap between said first stator and said second rotor and with a fourth air gap between said second rotor and said third stator.

12. The reed drive arrangement according to claim 7, wherein said electric motor is arranged above a weaving plane that intersects and extends through said reed.

13. The reed drive arrangement according to claim 7, wherein said electric motor is arranged below a weaving plane that intersects and extends through said reed.

14. The reed drive arrangement according to claim 13, further comprising a second one of said electric motor arranged above said weaving plane, and a second reed support that is rigidly connected to said reed and to a rotor of said second electric motor.

15. The reed drive arrangement according to claim 1, wherein said electric motor is arranged below a weaving plane that intersects and extends through said reed, and further comprising a second one of said electric motor arranged above said weaving plane, and a second reed support that is rigidly connected to said reed and to a rotor of said second electric motor.

16. The reed drive arrangement according to claim 1, further comprising a plurality of said electric motor and a plurality of said reed support respectively arranged distributed along a weaving width of said reed, with said reed supports respectively connecting said electric motors to said reed.

17. The reed drive arrangement according to claim 16, wherein said reed supports each have pass-through openings therein, and said first stators of said electric motors are coupled to one another respectively through said pass-through openings in a direction of said weaving width.

18. The reed drive arrangement according to claim 1, wherein said electric motor is a synchronous motor further comprising permanent magnets provided on said first stator.

19. The reed drive arrangement according to claim 1, wherein said electric motor is a transverse flux motor.

20. The reed drive arrangement according to claim 19, wherein said transverse flux motor further comprises permanent magnets provided on said first stator.

21. The reed drive arrangement according to claim 1, wherein said electric motor is a direct current motor.

22. The reed drive arrangement according to claim 21, wherein said direct current motor further comprises permanent magnet provided on said first stator.

23. The reed drive arrangement according to claim 1, wherein said electric motor is a reluctance motor.

24. The reed drive arrangement according to claim 23, wherein said reluctance motor further comprises permanent magnets provided on said first stator.

25. The reed drive arrangement according to claim 1, wherein said electric motor is an asynchronous squirrel-cage motor with said first rotor being short-circuited.

26. The reed drive arrangement according to claim 1, further comprising a braking device that is arranged in selective cooperation with said first rotor to selectively brake said first rotor independently of an operation of said electric motor.

27. The reed drive arrangement according to claim 26, wherein said braking device selectively applies a braking effect on said first rotor so as to stop said first rotor when said electric motor is not energized.

28. The reed drive arrangement according to claim 1, wherein said electric motor is a pivoting motion motor, said oscillating motion is a pivoting motion about a pivot axis, and said reed drive arrangement excludes a pivot shaft extending along said pivot axis.

29. The reed drive arrangement according to claim 1, wherein said electric motor is a pivoting motion motor, said oscillating motion is a pivoting motion about a pivot axis, and said pivot axis is a fictitious non-physical axis that is displaced away from all of said reed drive arrangement.

30. The reed drive arrangement according to claim 1, wherein said first stator has an opening therein, and said reed support extends from said first rotor through said opening to said reed.

31. A reed drive arrangement for a loom, comprising:

an electric motor including a stationary first stator and an oscillatable first rotor that is electromagnetically drivable to oscillate back-and-forth in an oscillating motion relative to said first stator, with a first air gap between said first stator and said first rotor;

a reed support rigidly connected to said first rotor so as to oscillate back-and-forth with said first rotor; and a reed carried by said reed support so as to oscillate back-and-forth with said reed support;

wherein said oscillating motion is a pivoting motion about a pivot axis, said first stator comprises a hollow annular cylindrical first stator shaft arranged coaxially with respect to said pivot axis, and said first rotor comprises a hollow annular cylindrical first rotor shaft arranged coaxially with respect to said pivot axis inside said first stator shaft.

32. A reed drive arrangement for a loom, comprising:

an electric motor including a stationary first stator, an oscillatable first rotor that is electromagnetically drivable to oscillate back-and-forth in an oscillating motion relative to said first stator, with a first air gap between said first stator and said first rotor, and a stationary second stator arranged with said first rotor between said first stator and said second stator, and with a second air cap between said second stator and said first rotor;

a reed support rigidly connected to said first rotor so as to oscillate back-and-forth with said first rotor; and a reed carried by said reed support so as to oscillate back-and-forth with said reed support.

33. A reed drive arrangement for a loom, comprising:

an electric motor including a stationary first stator and an oscillatable first rotor that is electromagnetically drivable to oscillate back-and-forth in an oscillating motion relative to said first stator, with a first air gap between said first stator and said first rotor;

a reed support rigidly connected to said first rotor so as to oscillate back-and-forth with said first rotor; and a reed carried by said reed support so as to oscillate back-and-forth with said reed support;

wherein said electric motor is a straight-line linear motion motor, said oscillating motion is a straight-line linear oscillating motion, said first stator has a linearly extending cross-sectional shape and a flat planar first stator surface that faces and bounds said first air gap, and said first rotor has a linearly extending cross-sectional shape and a flat planar first rotor surface that faces and bounds said first air gap.

34. The reed drive arrangement according to claim 33, wherein:

said electric motor further includes a stationary second stator arranged with said first rotor between said first stator and said second stator and with a second air gap between said second stator and said first rotor, said second stator has a linearly extending cross-sectional shape and a flat planar second stator surface that faces and bounds said second air gap, and said first rotor further has another flat planar rotor surface that faces and bounds said second air gap.

35. The reed drive arrangement according to claim 32, wherein said electric motor is a straight-line linear motion motor, said oscillating motion is a straight-line linear oscillating motion, said first stator has a linearly extending cross-sectional first stator shape and a flat planar first stator surface that faces and bounds said first air gap, said first rotor has a linearly extending cross-sectional first rotor shape and a flat planar first rotor surface that faces and bounds said first air gap, said second stator has a linearly extending cross-sectional second stator shape and a flat planar second stator surface that faces and bounds said second air gap, and said first rotor further has another flat planar rotor surface that faces and bounds said second air gap.

36. The reed drive arrangement according to claim 32, wherein said electric motor is a pivoting motion motor, said oscillating motion is a pivoting motion about a pivot axis, said first Stator has an arcuate annular segment cross-sectional first stator shape with an arcuate first stator surface facing and bounding said first air gap, said first rotor has an arcuate annular segment cross-sectional first rotor shape with an arcuate first rotor surface facing and bounding said first air gap, respective radii of curvature of said arcuate first stator surface and said arcuate first rotor surface originate at said pivot axis, said second stator has an arcuate annular segment cross-sectional second stator shape with an arcuate second stator surface facing and bounding said second air gap, and said first rotor further has another arcuate rotor surface facing and bounding said second air gap.

* * * * *

UNITED STATES PATENT AND TRADEMARK OFFICE

CERTIFICATE OF CORRECTION

PATENT NO. : 6,913,044 B2
DATED : July 5, 2005
INVENTOR(S) : Zwehl et al.

It is certified that error appears in the above-identified patent and that said Letters Patent is hereby corrected as shown below:

Title page,
Item [30], Foreign Application Priority Data, replace “101 54 941” by -- 101 54 941.5 --.

Column 4,
Line 16, after “section”, insert -- , --.

Coulmn 10,
Line 49, after “claim 1”, insert -- , --.
Line 56, before “comprising” delete “further”.

Column 11,
Line 67, before “provided” replace “magnet” by -- magnets --.

Column 12,
Line 57, before “between” replace “cap” by -- gap --.

Column 14,
Line 14, after “first” replace “Stator” by -- stator --.

Signed and Sealed this

Twentieth Day of December, 2005

JON W. DUDAS
*Director of the United States Patent and Trademark Office*